US009453370B2

(12) United States Patent
Bohlen et al.

(10) Patent No.: US 9,453,370 B2
(45) Date of Patent: Sep. 27, 2016

(54) ARCHITECTURAL COVERING AND METHOD OF SETTING AT LEAST ONE POSITION OF THE ARCHITECTURAL COVERING

(71) Applicant: Hunter Douglas Industries B.V., Rotterdam (NL)

(72) Inventors: Jorg Bohlen, Langen (DE); Lars Koop, Bremerhaven (DE)

(73) Assignee: Hunter Douglas Industries B.V., Rotterdam (NL)

( * ) Notice: Subject to any disclaimer, the term of this patent is extended or adjusted under 35 U.S.C. 154(b) by 0 days.

(21) Appl. No.: 14/380,857

(22) PCT Filed: Feb. 27, 2013

(86) PCT No.: PCT/NL2013/000010

§ 371 (c)(1),
(2) Date: Aug. 25, 2014

(87) PCT Pub. No.: WO2013/129917

PCT Pub. Date: Sep. 6, 2013

(65) Prior Publication Data

US 2015/0034258 A1 Feb. 5, 2015

(30) Foreign Application Priority Data

Feb. 27, 2012 (NL) ..... 2008360

(51) Int. Cl.

| | |
|---|---|
| ***E05F 15/20*** | (2006.01) |
| ***E06B 9/68*** | (2006.01) |
| ***E06B 9/88*** | (2006.01) |
| ***E06B 9/42*** | (2006.01) |
| *E06B 9/72* | (2006.01) |

(52) U.S. Cl.

CPC . *E06B 9/68* (2013.01); *E06B 9/42* (2013.01); *E06B 9/88* (2013.01); *E06B 9/72* (2013.01); *E06B 2009/6809* (2013.01)

(58) Field of Classification Search

CPC ..... E06B 2009/802; E06B 9/80; E06B 9/68; E06B 9/42; E06B 9/88; E06B 2009/6809; E06B 9/72

USPC ..... 160/1, 2, 7, 310

See application file for complete search history.

(56) References Cited

U.S. PATENT DOCUMENTS 8,643,321 B2 * 2/2014 Leivenzon ..... E06B 9/50 318/282
8,887,785 B2 * 11/2014 Goth ..... E04F 10/0614 160/66

(Continued)

FOREIGN PATENT DOCUMENTS

DE 102005002218 A1 7/2006
DE 202008015349 U1 3/2009

(Continued)

OTHER PUBLICATIONS

PCT International Search Report dated Jun. 21, 2013 for International Application No. PCT/NL2013/00010, 3 pages.

*Primary Examiner* — Katherine Mitchell
*Assistant Examiner* — Johnnie A Shablack
(74) *Attorney, Agent, or Firm* — Dorsey & Whitney LLP

(57) ABSTRACT

A architectural covering, such as a shutter, blind or shade, comprising a control unit for controlling a motor so as to adjust the position of the architectural covering, wherein the control unit includes a housing and a circuit means, which is provided with switching means which upon actuation allow for the setting of at least one position of the architectural covering in the circuit means. The housing includes a tool receiving section for releasable engagement with a tool for actuating the switching means.

24 Claims, 7 Drawing Sheets

(56) References Cited

U.S. PATENT DOCUMENTS

| | | | | |
|---|---|---|---|---|
| 2004/0035535 | A1* | 2/2004 | Petrongolo | E06B 9/76 160/310 |
| 2006/0158045 | A1* | 7/2006 | Speri | E06B 9/72 310/1 |
| 2013/0020969 | A1* | 1/2013 | Leivenzon | E06B 9/68 318/16 |
| 2014/0096920 | A1* | 4/2014 | MacDonald | E06B 9/50 160/291 |
| 2015/0034258 | A1* | 2/2015 | Bohlen | E06B 9/68 160/310 |

FOREIGN PATENT DOCUMENTS

| | | | | |
|---|---|---|---|---|
| FR | 2997125 | A1 * | 4/2014 | E06B 9/68 |
| IT | WO 2004007891 | A1 * | 1/2004 | E06B 9/72 |
| IT | EP 2161818 | A1 * | 3/2010 | E06B 9/72 |
| WO | 2011018223 | A2 | 2/2011 | |
| WO | WO 2015017833 | A2 * | 2/2015 | E06B 9/42 |

* cited by examiner

Fig. 3
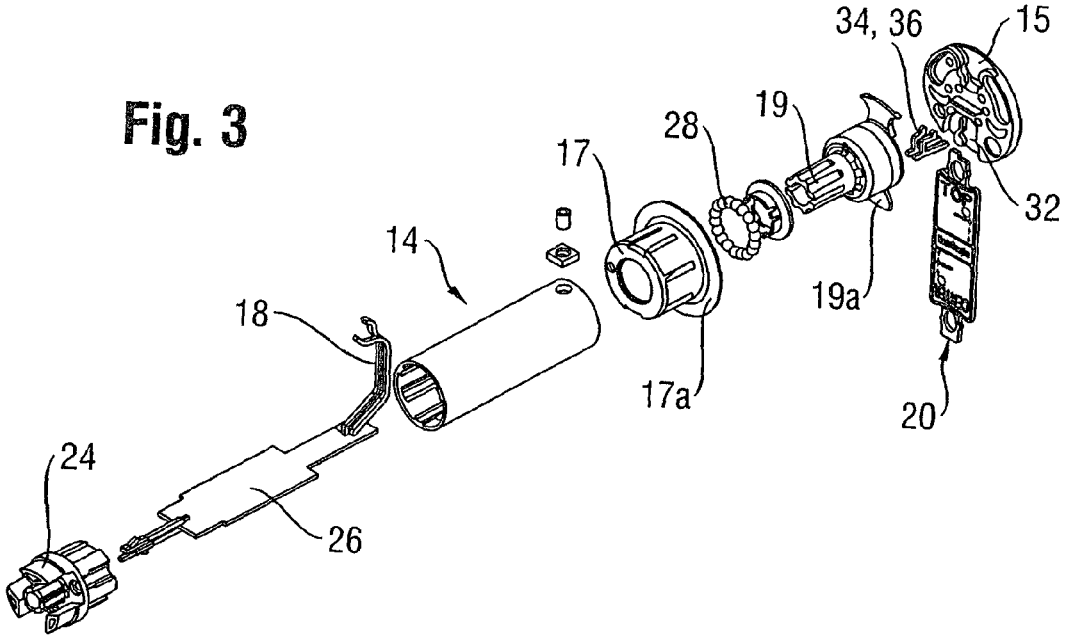
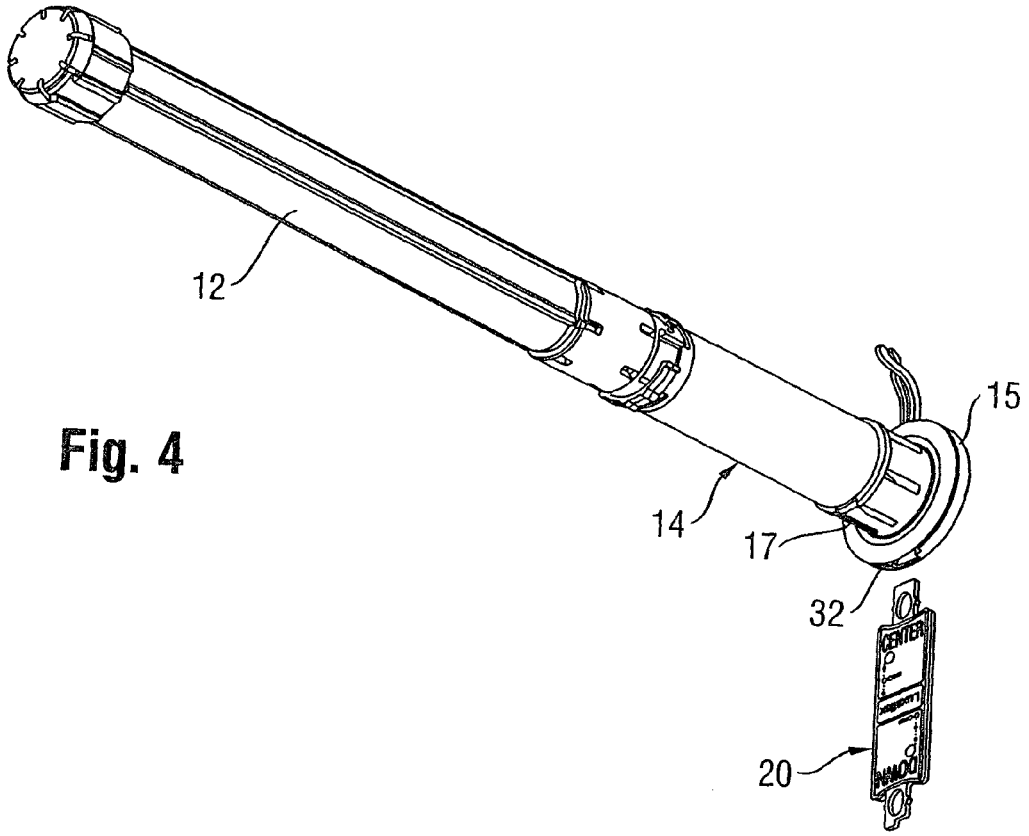
Fig. 4

Fig. 11
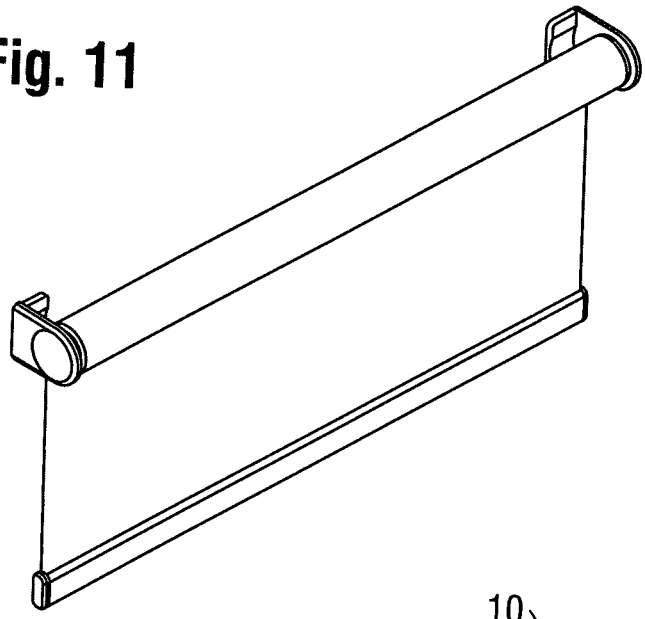
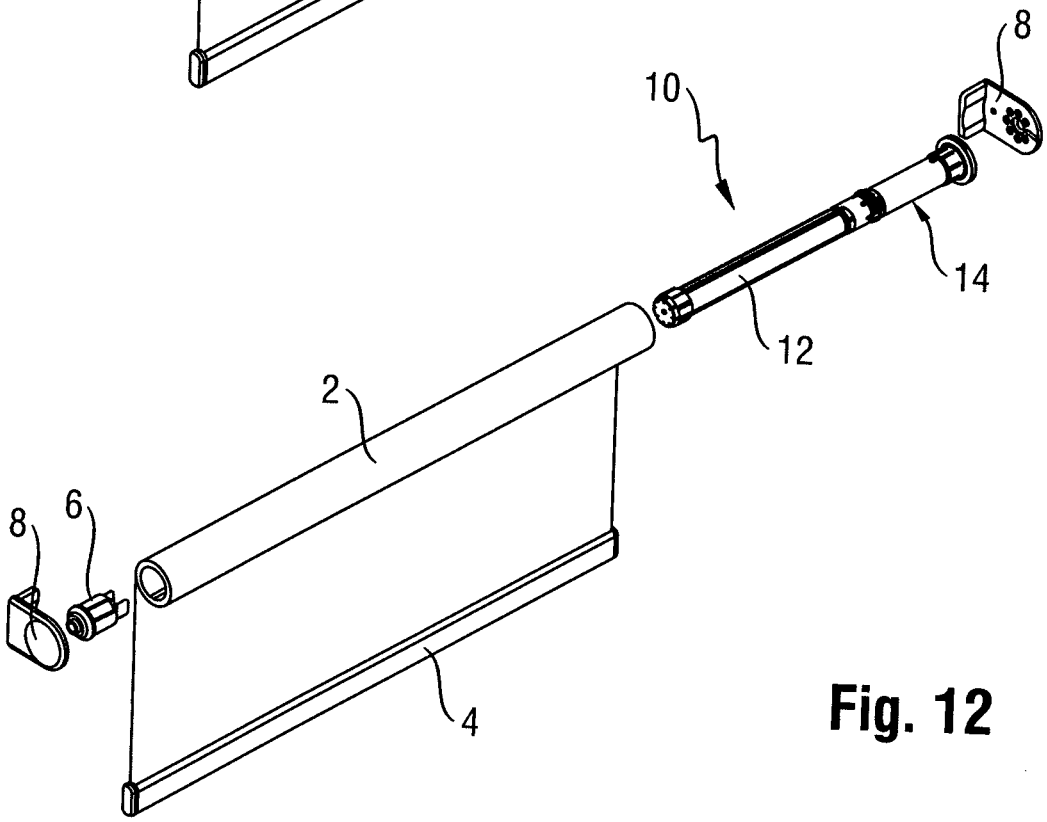
Fig. 12

ARCHITECTURAL COVERING AND METHOD OF SETTING AT LEAST ONE POSITION OF THE ARCHITECTURAL COVERING

CROSS-REFERENCE TO RELATED APPLICATIONS

This application is the national stage application of International Patent Application No. PCT/NL2013/000010, filed Feb. 27, 2013, entitled "Architectural Covering and Method of Setting at Least One Position of the Architectural Covering," which claims priority to Netherlands Patent Application No. 2008360, filed Feb. 27, 2012, entitled "Architectural Covering and Method of Setting at Least One Position of the Architectural Covering," which are hereby incorporated by reference herein in their entireties.

TECHNICAL FIELD

The present invention applies to an architectural covering comprising a control unit for setting at least one position of the architectural covering. The present invention also applies to a method of setting at least one position of such an architectural covering.

Architectural coverings such as roller shades, shutters, honeycomb shades, plissés, roman shades, venetian blinds, etc., may be provided with a motor unit to assist a user in lowering and raising the coverings and/or tilting slats or vanes thereof. Typically, the motor unit comprises a motor and a control unit. The motor and the control unit may be both housed in the roller tube in case of a roller blind, or in the head rail, intermediate rail or bottom rail in case of for instance a venetian blind or pleated blind.

After installation of the architectural covering, one or more end limits are usually programmed by the user: the motor unit is taught where the lower limit is when lowering the covering, and generally an upper limit is also programmed. With more advanced control software, it is possible to set further, intermediate limits.

The setting of such limits may also be important in the case of larger projects in which several architectural coverings are provided and are controlled centrally, in a synchronized manner. By teaching corresponding intermediate levels into the respective motor units, the coverings can all be stopped at the same level, which may be advantageous from an aesthetic point of view.

PRIOR ART

DE-A1-10 2005 002218 shows a roller shutter having a shaft, a winding roller, a driving motor and two manually adjustable limit setting means. These limit setting means can be rotated by an appropriate key to set the upper and lower limit of the roller shutter.

WO-A2-2011018223 shows a driving assembly for a roller shutter having a first disengageable clutch connected to a guide tube, and a second disengageable clutch connected to a drive shaft. A key can be inserted into either one of the clutches for keeping its parts apart, thereby allowing the limits of the driving assembly to be set.

DISCLOSURE OF THE INVENTION

It is the object underlying the invention to provide an architectural covering with a control unit for adjusting the position of the covering, by means of which at least one position of the covering, in particular an upper or a lower end position and/or an intermediate position, can easily be programmed by the operator. It is also the object underlying the invention to provide a method for setting at least one position of such an architectural covering.

This object is, on the one hand, achieved by means of an architectural covering, such as a shutter, blind or shade, comprising a control unit for controlling a motor so as to adjust the position of the architectural covering according to claim 1. The control unit of the architectural covering includes

- a housing, and
- a circuit means, which is provided with switching means which upon actuation allow for the setting of at least one position of the covering in the circuit means. The housing includes a tool receiving section for releasable engagement with a tool for actuating the switching means.

The solution of the present invention is a simple solution, and it is relatively foolproof. In order to program a position of the architectural covering, the operator only has to insert the tool into the tool receiving section so as to actuate the switching means of the control unit.

Preferred optional features are recited in the dependent claims.

The switching means can be arranged for direct interaction with the tool. As an alternative, the control unit may further comprise setting means which are so arranged as to be engaged with the tool so as to in turn actuate the switching means.

The setting means may include at least one setting element which is supported in the housing. The setting element may be for example pivotably supported. Each of the setting elements may have a first contact surface for engagement with the tool, and a second contact surface for actuating the switching means. Upon engagement between the tool and the first contact surface of the setting element, the second contact surface of the setting element actuates the switching means.

In an exemplary embodiment, the switching means include at least two switches, and the setting means include at least two setting elements associated with the respective switches. In the case in which two switches are provided, three positions could be programmed actuating either one of the switches or both of the switches (0/1, 1/0, or 1/1). Alternatively, one of the switches could be used to set other control parameters, such as a "synchronised" mode, wherein the operation of the covering is synchronized with that of other coverings. One of the programming options could also be used to cancel previous settings, allowing the end limits to be re-set.

In more general terms, the switching means may be arranged for setting at least one further control parameter in addition to the at least one position of the covering.

The circuit means is preferably at least partly accommodated within the housing. The engagement between the tool, which extends through the tool receiving sections of the housing, and the switching means or the setting means is facilitated thereby.

On the other hand, the above object is achieved by means of an architectural covering in accordance with claim 8, including the control unit described above, and further including a tool.

The tool preferably includes at least one actuating portion for being inserted into the tool receiving section, and each of the actuating portions may include at least one actuating surface for acting upon the switching means upon insertion of the actuating portion into the tool receiving section. In case the above described setting means are present, the actuating surface of the tool acts upon the setting means which in turn act upon the switching means.

In a preferred embodiment, at least one of the actuating portions of the tool is arranged so as to be introduced into the tool receiving section in two different orientations, and the actuating surface of said actuating portion is arranged so as to selectively actuate the switching means dependent on the orientation of the tool.

Alternatively or in addition, the tool may comprise at least two actuating portions, and the actuating surfaces of said actuating portions are arranged so as to selectively actuate the switching means dependent on which of the actuating portions is inserted into the tool receiving section.

Consequently, the switching means (or the setting means, if any) may be selectively actuated by means of one and the same actuating portion which is used in different orientations, and/or by means of at least two different actuating portions of the tool.

According to a preferred optional feature, the tool receiving section is provided with retaining means for cooperating with corresponding retained means of the tool so as to provide a tactile feedback when the tool is inserted.

The control unit may be provided at one longitudinal end of the architectural covering, in a rail or winding core thereof. Where the architectural covering is a roller blind, the control unit may partially extend within a roller tube of the roller blind, while an access opening of the tool receiving section of the control unit is arranged outside the roller tube. Preferably, the biggest part of the control unit is arranged within the roller tube and only that part of the control unit which is provided with the access opening extends outside the roller tube. In this manner the control unit barely has an influence on the required installation space.

The control unit may be separate from the motor and include means for connection with the motor and/or with a spring unit.

The tool receiving section preferably has a narrow, slot-shaped access opening. The corresponding tool is preferably made from a thin, flexible material such as PE or POM so as to have a substantially card- or plate-like appearance. The thickness could for example be about 1.6 mm. If the tool is as thin as a credit card, the light gap between the covering and the window frame can be small.

On the other hand, the above object is also achieved by a method of setting at least one position of an architectural covering of the type described above in accordance with claim 20. The method comprises the step of setting a first position of the architectural covering in the circuit means by inserting one of the actuating portions of the tool into the tool receiving section of the control unit so as to act upon the switching means.

The method preferably includes the additional step of setting at least one further position of the architectural covering in the circuit means by inserting one of the actuating portions of the tool into the tool receiving section of the control unit so as to act upon the switching means. If so, the orientation of the tool is changed for setting the different positions of the architectural covering. For example, the tool may be reversed about at least one of its axes for setting two different position of the architectural covering. At least two different positions may be set by means of the same actuating portion of the tool. In this case this actuating portion of the tool is constructed so as to selectively actuate the switching means dependent on the orientation in which the tool is used. This could for example be achieved by an asymmetric or offset construction of the actuating portion.

At least two different positions of the architectural covering may also be set by means of two different actuating portions of the tool. In this case the actuating portions of the tool are constructed so as to selectively actuate the switching means dependent on which one of the actuating portions is used.

BRIEF DESCRIPTION OF THE DRAWINGS

FIG. 3 is an exploded view of only the control unit.

FIG. 4 is an assembled view of the motor unit from a different perspective.

FIG. 11 shows an architectural covering according to the present invention, more particular a roller blind, in an assembled state.

FIG. 12 shows the roller blind of FIG. 11 in an exploded view.

DETAILED DESCRIPTION OF A PREFERRED EMBODIMENT

Figure 1:
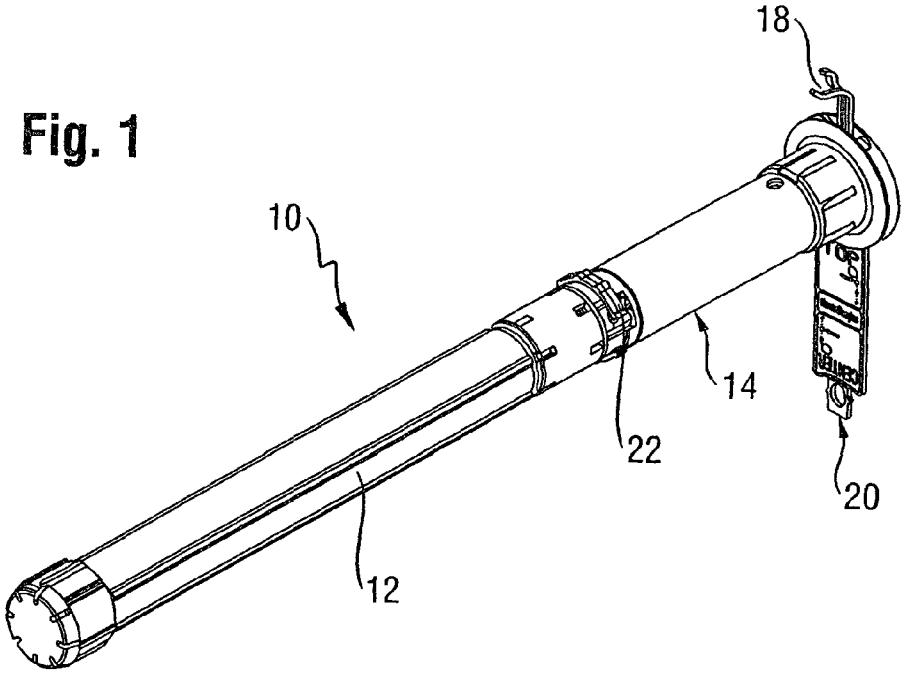
FIG. 1 is an assembled view of a motor unit incorporating a control unit according to the present invention.

A preferred embodiment of the architectural covering according to the present invention, more particular a roller blind will be explained below with reference to the accompanying drawings.

The roller blind is shown in an assembled state in FIG. 11, and FIG. 12 shows the roller blind in an exploded view. The roller blind is constituted by a roller tube 2 with fabric having a bottom rail 4 at its bottom end. At its first end, the roller tube 2 is supported by means of a roller bearing 6. At its second end, a motor unit 10, which is constituted by the actual motor 12 as well as a control unit 14, is accommodated within the roller tube 2. Brackets 8 are provided to mount both ends of the roller blind to a wall or window frame.

Figure 2:
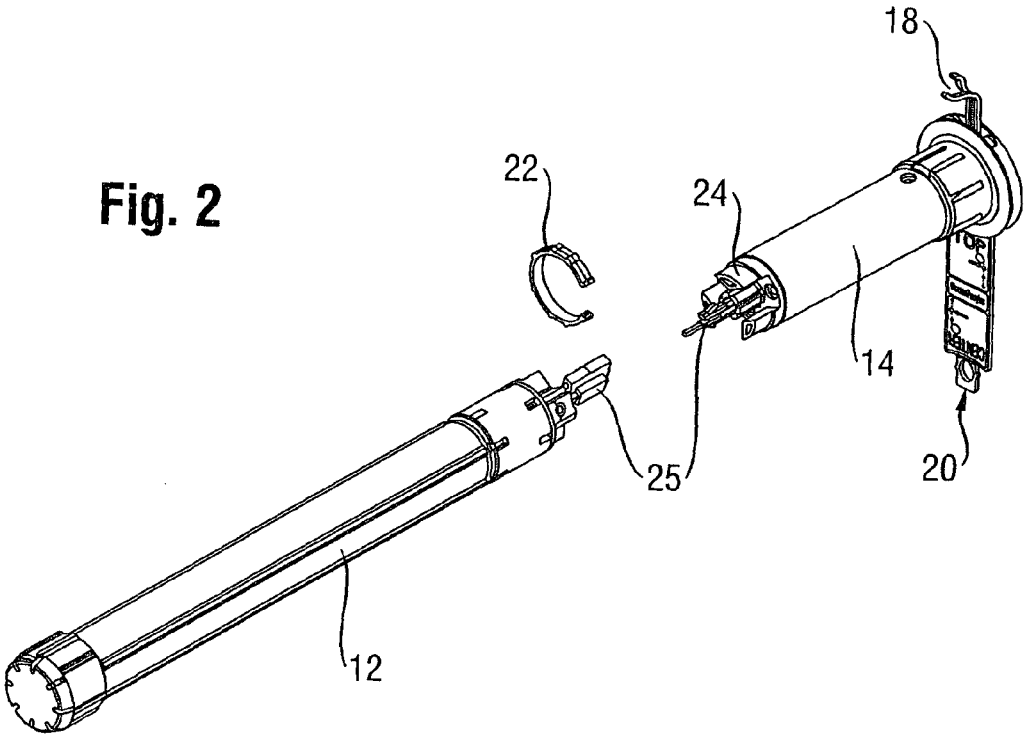
FIG. 2 is an exploded view of the motor unit of FIG. 1.

FIGS. 1 and 2 show an assembled and an exploded view, respectively, of the motor unit 10 of FIG. 12. The control unit 14 is constituted in accordance with the present invention, in order to allow the user to program positions of the roller blind, in particular an upper and a lower end limit as well as, for example, at least one intermediate position. Other control parameters may also be set, such as a "synchronised" mode, wherein the operation of the covering is synchronized with that of other coverings. One of the programming options may also be used to cancel previous settings, allowing the first and second end limit to be re-set.

In contrast to conventional motor arrangements for architectural coverings, the control unit 14 may be designed as a separate component that may be connected to the motor 12 via a special coupling arrangement. In the present case, this connection is effected by means of a mechanical coupling element 24 and an electrical coupling 25. A bearing collar clip 22 is mounted in the vicinity of the connection between the motor 12 and the control unit 14 to provide additional support to the motor arrangement and prevent it from sagging against the interior of the roller tube 2. This bearing collar clip 22 is an optional element that may not be required in any case.

Electric energy is supplied to the control unit 14 and transmitted to the motor 12. FIGS. 1 and 2 show a corresponding cable connection at 18.

FIG. 3 is an exploded view of only the control unit 14. From the Figure it becomes apparent that the control unit 14 includes a housing, which in the present case is constituted by a substantially plate-shaped first housing part 15 and a second housing part 17 which is hollow cylindrical and has a circumferential flange 17*a* facing the first housing part 15.

Between the first 15 and the second housing part 17, an inner sleeve 19 is provided. The inner sleeve 19 is substantially hollow cylindrical and is sized so as to fit into the hollow cylindrical second housing part 17. On its side facing the first housing part 15, the inner sleeve 19 comprises two flange-like protrusions 19*a* on its circumference. One of these protrusions 19*a* cooperates with the first housing part 15 so as to form a tool receiving slot 32. The slot 32 is also illustrated in FIG. 4, which is an assembled view of the motor unit 10 from a different perspective.

The control unit 14 also comprises a ball bearing 28 in order to minimize axial and radial friction. The second part 17 of the housing is supported relative to the inner sleeve 19 by means of said ball bearing 28. Consequently, the second part 17 is rotatably supported relative to the inner sleeve 19 which remains stationary, as does the first housing part 15.

Note that the motor unit 10 forms part of a roller blind as shown in FIGS. 11 and 12. In the mounted state of the motor unit 10, both the motor 12 and the biggest part of the control unit 14 are accommodated within the roller tube of the roller blind, whereas the first housing part 15 of the control unit 14 remains outside the roller tube so as to provide access to the slot 32. As only the narrow, plate-shaped first housing part 15 of the control unit 14 extends beyond the roller tube, the gap between the roller tube and the adjoining wall or window frame is comparatively small. This provides the advantage that the amount of light coming in via said gap when the blind is lowered is minimized.

Figures 5A, 5B, 5C:
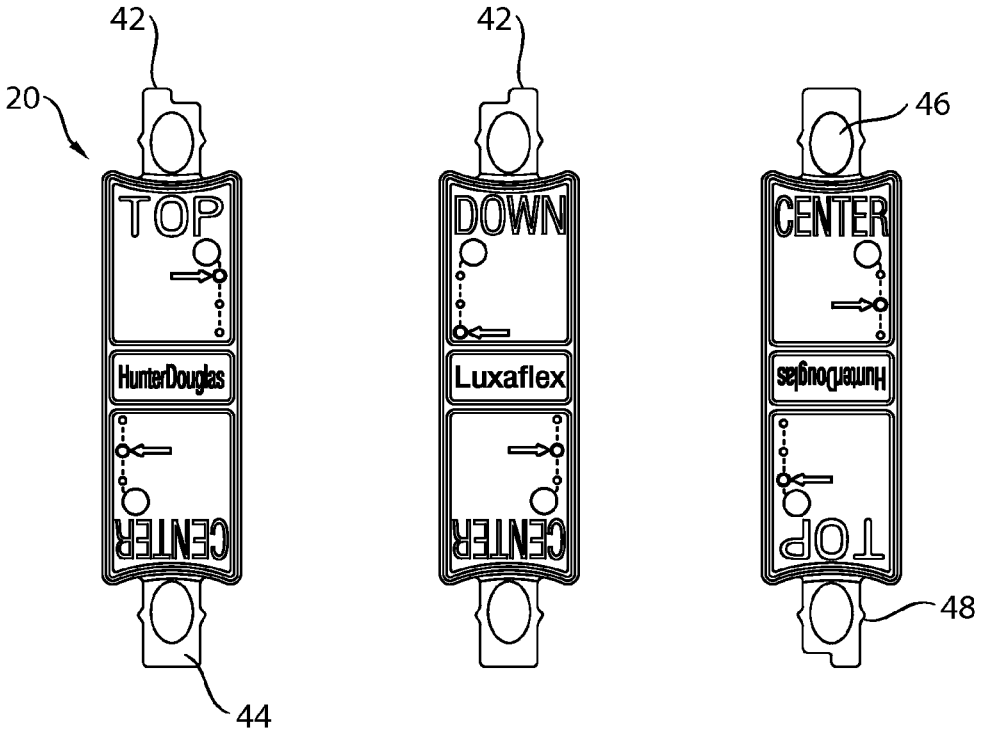
FIGS. 5A-5C show a tool or key for cooperating with the control unit.
Figures 6A, 6B, 6C:
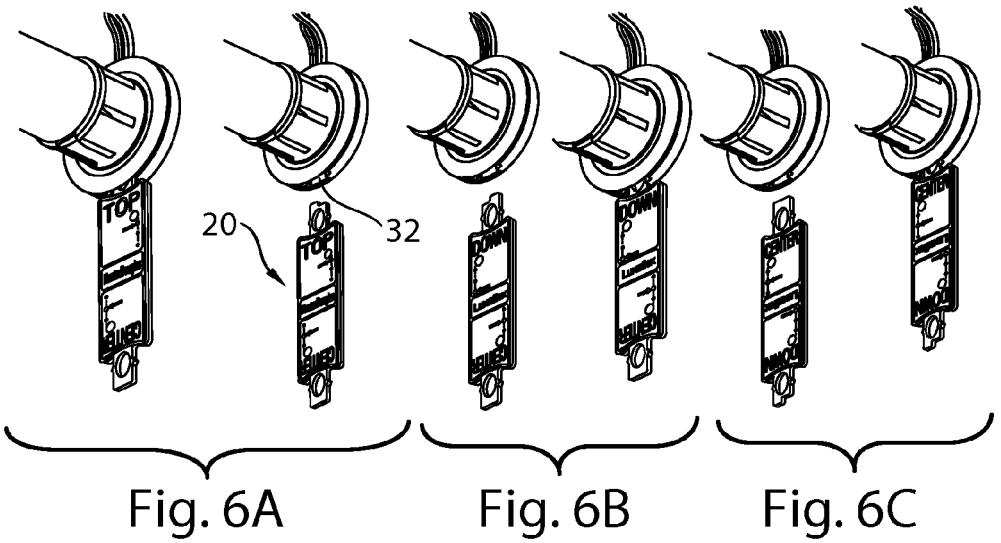
FIGS. 6A-6C show the three different orientations in which the tool can be used.

FIGS. 5A-C show a tool or key 20 for cooperating with the control unit 14 in order to allow the user to program, for example, three different positions or levels of the roller blind. The tool 20 is constructed so that it can be inserted into the tool receiving slot 32 in several different orientations (see FIG. 5A, FIG. 5B, and FIG. 5C) so as to selectively program these three positions. FIGS. 6A-6C again show these three different orientations in which the tool 20 can be used.

As an alternative to the setting of three different levels of the architectural covering, the arrangement could be such that the different orientations of the tool 20 are used for setting two end limits, and the third option is used for setting another control parameter such as a "synchronised" mode, wherein the operation of the covering is synchronized with that of other coverings. The third programming option could also be used for re-setting the end limits.

The tool 20 has a generally longitudinal shape and includes at a first end thereof a key bit which is a first actuating portion and has a single, narrow protrusion providing a first actuating surface 42. At the second end, the tool 20 includes a key bit which is a second actuating portion and has a second actuating surface 44 which is larger than the first one 42.

The tool 20 is further provided with text, as illustrated in FIGS. 5A-5C, to instruct the user in which orientation the tool is to be used in order to set a particular position of the roller blind. Further informative and/or decorative items such as numbers, icons, colours, etc. could also be provided on the tool 20.

FIGS. 5A-5C and 6A-6C illustrate how the tool 20 of FIGS. 5A-5C is used for programming the three levels of the roller blind:

in order to set the upper end limit of the roller blind, the tool 20 is inserted into the slot 32 with the designation "top" facing upwards and towards the operator (or rather towards the center of the roller blind, rather than towards the wall or window frame to which the end of the roller blind including the control unit 14 is mounted);

in order to set the lower end limit of the roller blind, the tool 20 is inserted into the slot 32 with the designation "down" facing upwards and towards the operator.

in order to set an intermediate position of the roller blind, the tool 20 is inserted into the slot 32 with the designation "center" facing upwards and towards the operator.

The key bits at the ends of the tool 20 are further provided with openings 46 which provide some resilience.

Retained means in the form of projections 48 at either side of the key bit provide for a tactile feedback when the key bit is inserted into the slot 32 in the control unit 14.

With reference to FIGS. 7A-7C and 8A-8C it will now be described how the tool 20 interacts with the control unit 14 in order to set the respective positions of the roller blind.

To this extent, the control unit 14 includes a circuit means in the form of a printed circuit board (PCB) 26 which may provide an interface between an external control and the motor 12. The external control is provided in a manner known as such, e.g. in the form of an infrared (IR) or radio frequency (RF) control, a KNX control, or the like, and is not illustrated here in more detail.

For setting the end limits of the roller blind, the circuit board 26 is provided with switches. In the present embodiment, two switches 38 and 40 are provided which allow the setting or teaching-in of the three different positions of the roller blind: a first position is set by actuating only the first switch 38 (setting "1/0"), a second position is set by actuating only the second switch 40 (setting "0/1"), and a third position is set by actuating both switches 38 and 40 (setting "1/1").

The switches 38, 40 could generally be actuated directly by the actuating surfaces 42, 44 of the tool 20. In the present embodiment, however, additional setting means are provided in the form of levers 34, 36, each being associated with one of the switches 38, 40. The levers 34, 36 are supported in the housing in a pivotable manner. The levers 34, 36 each have a contact surface for acting upon the respective switch 38, 40 and another contact surface for engagement with a corresponding actuating surface 42, 44 of the tool 20. Due to this construction, the tool 20 actuates one or both of the levers 34, 36 which in turn actuate the associated switch(es) 38, 40 on the PCB 26.

FIGS. 7A-7C and 8A-8C show in more detail how the setting means inside the control unit 14 are actuated if the tool 20 is inserted into the slot 32 thereof. Based on these Figures the operation of the control unit according to the present invention will now be described.

Figure 7A:
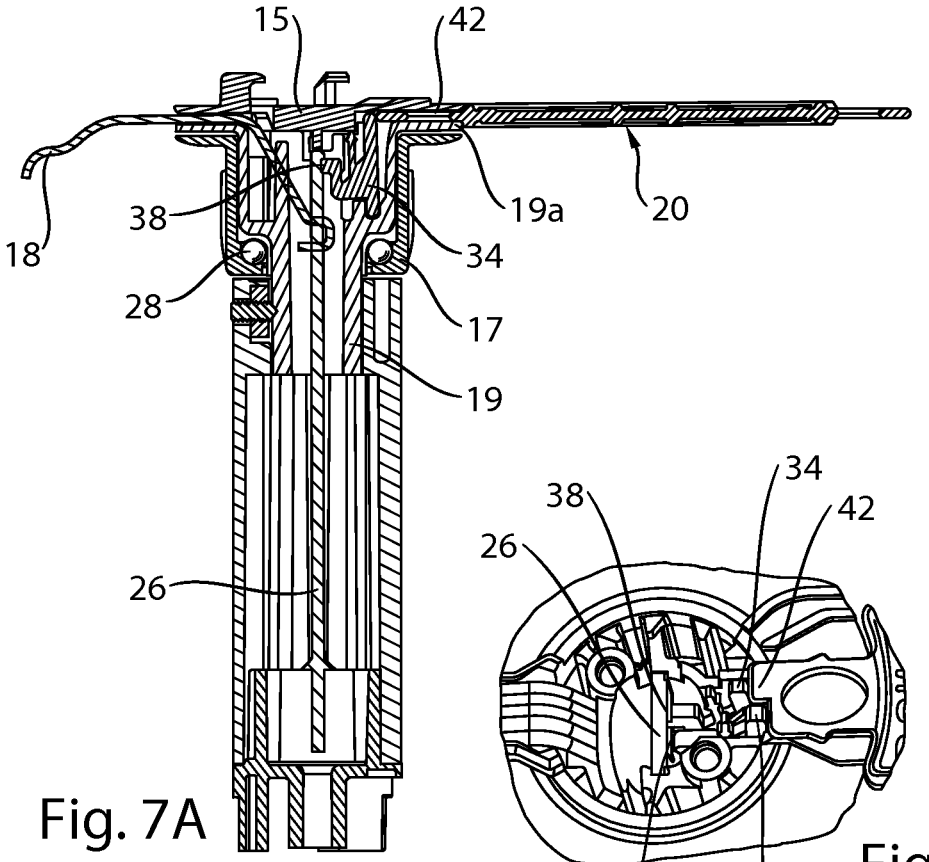
FIGS. 7A-7C show the inside of the control unit when a first switch thereof is actuated.
Figure 7B:
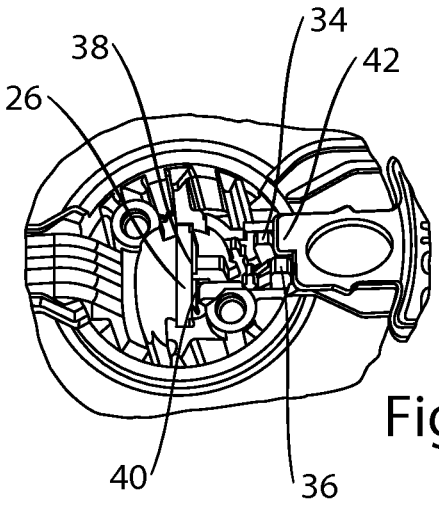
Figure 7C:
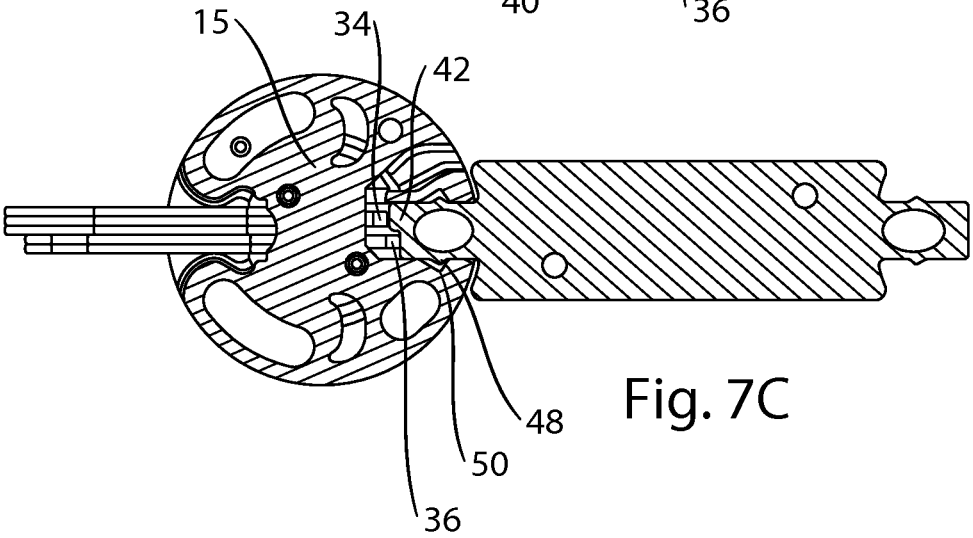

First of all, in order to teach in the lower end position of the roller blind, the blind is lowered into the desired lowermost position. The first end of the tool 20, having the narrow protrusion providing the first actuating surface 42, is inserted through the slot 32 of the control unit 14, with that side having the end marked "down" on it facing to the front. FIGS. 7A-7C show how the first lever 34 is thereby actuated by means of the narrow first actuating surface 42 of the key bit at the first end of the tool 20. The first switch 38 on the PCB 26 is operated accordingly, in order to set a first end limit of the roller blind.

Figure 8A:
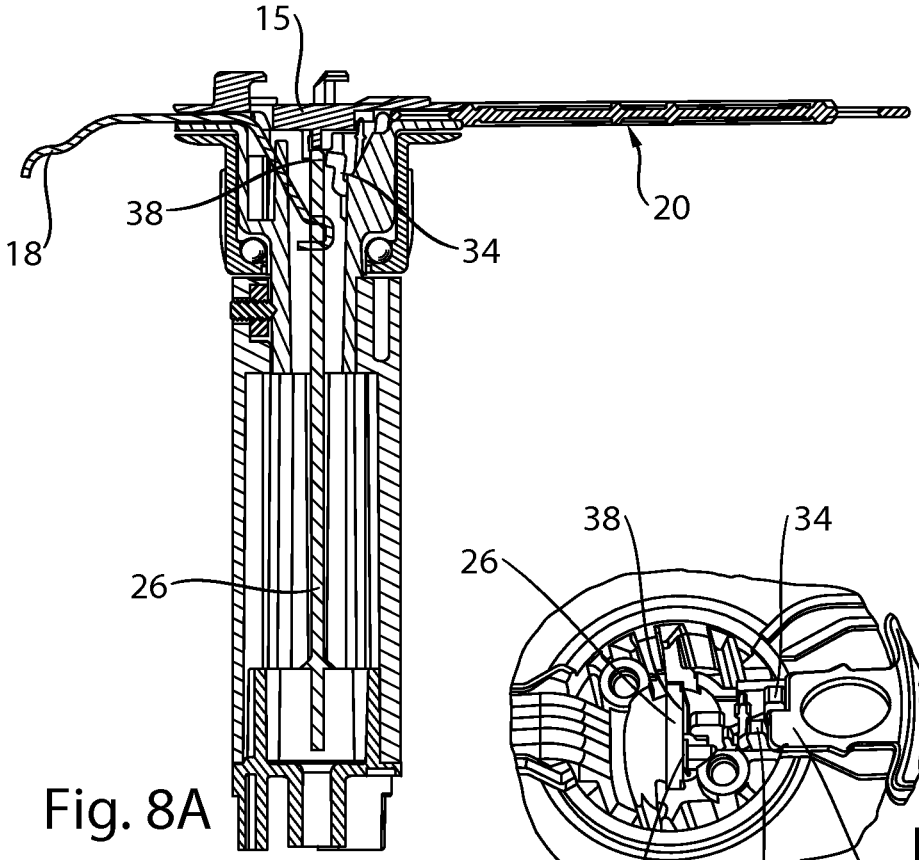
FIGS. 8A-8C show the inside of the control unit when a second switch thereof is actuated.
Figure 8B:
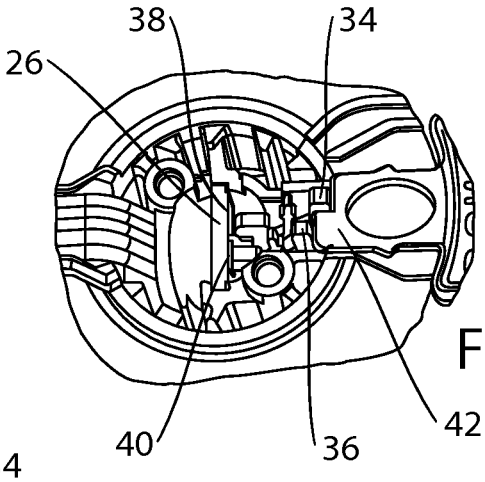
Figure 8C:
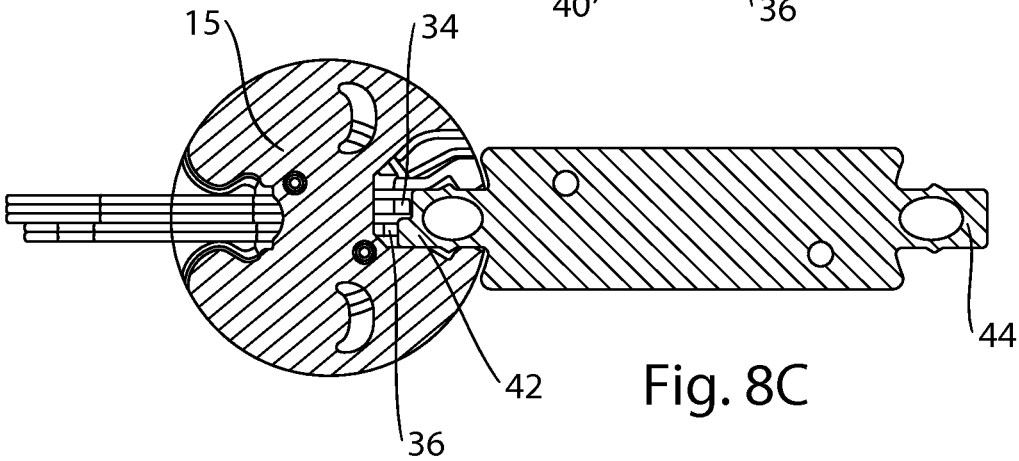

Next, the shade is raised to the desired uppermost position. The tool 20 is removed from the slot, reversed around its longitudinal axis over 180 degrees so that the opposite side (with the end having marked "top" on it) faces to the front, and the "top" end of the tool 20 is inserted into the slot 32. This configuration is shown in FIGS. 8A-8C. The inserted end of the tool 20 now actuates the second lever 36 which in turn actuates the second switch 40, thereby setting the upper limit of the roller blind.

From FIGS. 7A-7C and 8A-8C one can also imagine how both levers 34, 36 would be actuated if the other end of the tool 20 having the broader protrusion 44 was inserted into the slot 32 of the control unit 14. By activating both buttons at the same time, an intermediate level could be set, or the device could be reset (depending on how the switch has been pre-programmed).

Due to their particular structure, the levers 34, 36 act as amplifiers between the key bit and the switches 38, 40. The levers 34, 36 furthermore can bridge a lateral distance between the actuating surfaces 42, 44 of the tool and the switches 38, 40, thereby allowing the switches to be located more inward in the roller tube. The levers 34, 36 are supported by means of the inner sleeve 19 and the first housing part 15 so as to be biased out of contact with the switches 38, 40.

Note that the tool 20 is used for mechanically actuating the switches 38, 40, in the present embodiment via the levers 34, 36. For this reason, the control unit 14 of the present invention can also be used for architectural blinds in which a voltage is not continuously applied to the motor 12, but only when the motor is to be driven: By means of the control unit 14 and the tool 20 described above, end positions of an architectural blind can be programmed even if the motor 12 thereof is not permanently power supplied. To this extent, the tool 20 would be used as follows: in order to set a particular end limit, the tool 20 is inserted (in the proper orientation) into the tool receiving section 32 of the control unit 14, and the switch(es) 38, 40 is/are mechanically pressed. As soon as a voltage is applied to the motor 12, the motor 12 is driven, and a setting mode is activated. When the covering has been lowered or raised to the desired position, the voltage is released, and the motor stops. The tool 20 is then removed so as to release the switch(es) 38, 40. When a voltage is now again applied to the motor 12 while the switches 38, 40 are not actuated any more, this particular position of the architectural blind is stored as an end limit.

FIGS. 7A-7C and 8A-8C also make it clear how the retained means or projections 48 formed on the key bits engage with correspondingly shaped retaining means or notches 50 formed inside the slot 32 in the housing plate 15 of the control unit 14 so as to provide a tactile feedback when the tool 20 is inserted.

Due to the particular formation of the actuating surfaces 42, 44 on both ends of the tool 20, the selective activation of the setting means becomes possible. In the present embodiment, this is both due to the fact that the second actuating surface 44 is broader than the first one 42 so that dependent on which longitudinal end of the tool 20 is inserted into the slot 32, only one or both of the switches 38, 40 are actuated. Secondly, the protrusion having the first actuating surface 42 is offset from the longitudinal axis of the tool 20 so that reversion of the tool 20 about its longitudinal axis allows for selective actuation of either of the switches 38, 40 by means of the actuating surface 42.

Figure 9:
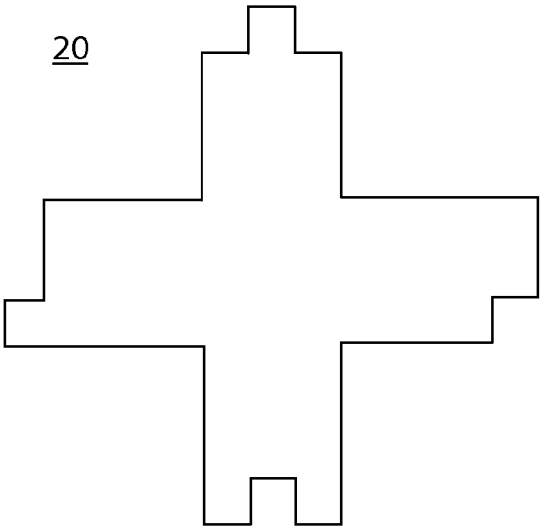
FIG. 9 shows an alternative tool according to the present invention.

In case it is intended to set more than three positions (two end limits and one intermediate position) of the roller blind, the setting means of the control unit 14 would include more than two levers, and the tool 20 would be designed so as to selectively actuate these several levers and set the positions. An example of a correspondingly "+" shaped tool 20, which would cooperate with three levers of the control unit 14, is shown in FIG. 9. This tool 20 has four actuating portions.

As an alternative, the key or tool could for instance be T-shaped, so as to have three actuating portions.

The shape of these actuating portions may also be more complex than illustrated in the above embodiments, so as to cover more switch combinations.

Figure 10A:
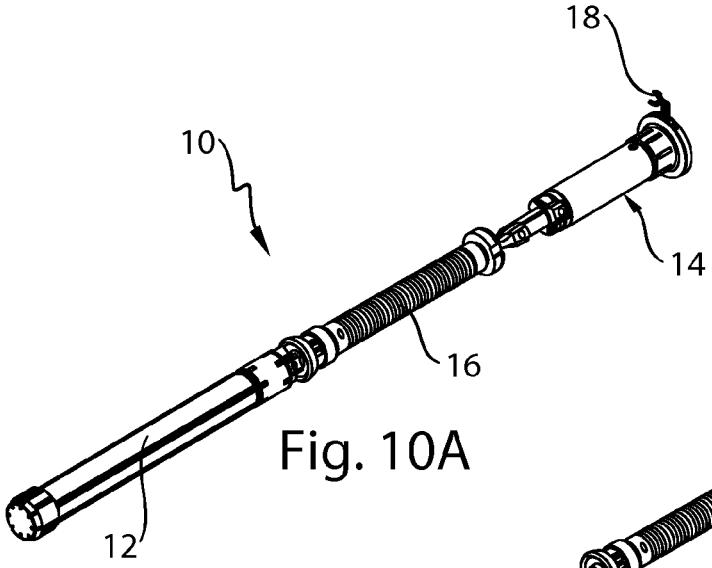
FIGS. 10A and 10B include an assembled and an exploded view of another motor unit incorporating the control unit of the present invention.
Figure 10B:
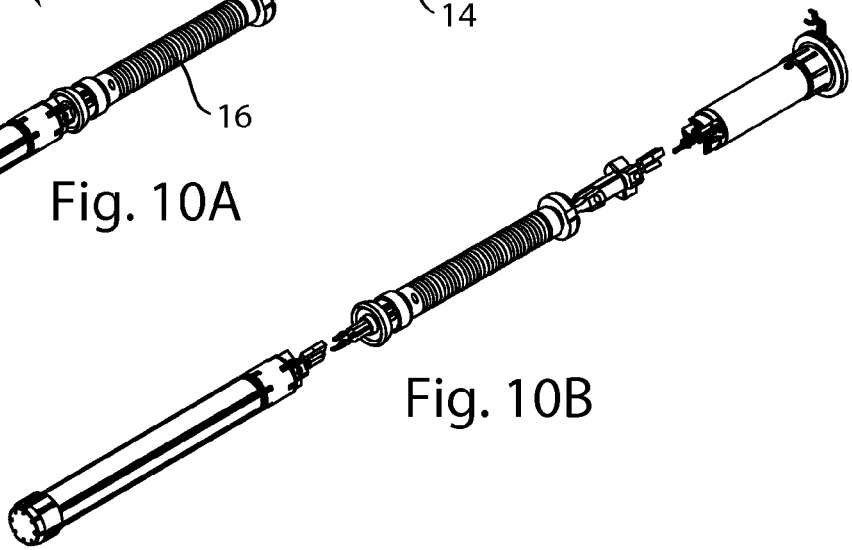

Finally, FIGS. 10A and 10B are detailed views (assembled and exploded) of another motor unit 10 which also incorporates the control unit 14 of the present invention. Other than the motor unit 10 described above, this motor unit 10 includes an additional spring unit 16 interposed between the motor 12 and the control unit 14. In this case, the mechanical and electrical coupling elements 24, 25 and the ring-shaped connection element 22 are used to connect the control unit 14 with the spring unit 16 which in turn is connected with the motor 12. The spring unit 16 can store kinetic energy when the blind is lowered and release this energy when the blind is raised so as to support the motor. As the control unit 14 is similar to the one of the above described embodiment, the above described tool 20 can be used with this embodiment as well.

The invention claimed is:

1. An architectural covering comprising:

a control unit configured to control a motor to adjust the position of the architectural covering, the control unit comprising:

a housing including a tool receiving section; and a printed circuit board provided with at least one switch for setting at least one position of the architectural covering in the printed circuit board upon actuation of the at least one switch; and a tool for actuating the at least one switch, the tool including at least one actuating portion for insertion into the tool receiving section, each of the at least one actuating portion including at least one actuating surface for acting upon the at least one switch upon insertion of the at least one actuating portion into the tool receiving section, at least one of the at least one actuating surface is offset from a longitudinal axis of the tool so that selective orientation of the tool about the longitudinal axis provides selective actuation of the at least one switch by the at least one of the at least one actuating surface.

2. The architectural covering of claim 1, in which the at least one switch is arranged for direct interaction with the tool.

3. The architectural covering of claim 1, in which the at least one switch is arranged for setting at least one further control parameter in addition to the at least one position of the covering.

4. The architectural covering of claim 1, in which the printed circuit board is at least partly accommodated within the housing.

5. The architectural covering of claim 1, in which at least one of the at least one actuating portion of the tool is arranged so as to be introduced into the tool receiving section in two different orientations, and the actuating surface of said actuating portion is arranged so as to selectively actuate the at least one switch dependent on the orientation of the tool.

6. The architectural covering of claim 1, in which the tool comprises at least two actuating portions, and the at least one actuating surface of the at least two actuating portions are arranged so as to selectively actuate the at least one switch dependent on which of the at least two actuating portions is inserted into the tool receiving section.

7. The architectural covering of claim 1, in which the tool receiving section is provided with one of at least one notch or projection and the tool is provided with the other of the at least one notch or projection so as to provide a tactile feedback when the tool is inserted.

8. The architectural covering of claim 1, wherein the control unit is provided at one longitudinal end of the architectural covering, in a rail or winding core thereof.

9. The architectural covering of claim 1, wherein the architectural covering is a roller blind, and wherein the control unit partially extends within a roller tube of the roller blind, while an access opening of the tool receiving section of the control unit is arranged outside the roller tube.

10. The architectural covering of claim 1, wherein the control unit is separate from and connectable with the motor.

11. The architectural covering of claim 1, wherein the tool receiving section has a narrow, slot-shaped access opening.

12. The architectural covering of claim 1, wherein the tool is made from a thin, flexible material.

13. The architectural covering of claim 1, in which the control unit further comprises at least one setting element which is so arranged as to be engaged with the tool so as to in turn actuate the at least one switch.

14. The architectural covering of claim 13, in which the at least one setting element is supported in the housing.

15. The architectural covering of claim 14, in which each of the at least one setting element has a first contact surface for engagement with the tool, and a second contact surface for actuating the at least one switch.

16. The architectural covering of claim 14, in which the at least one switch includes at least two switches, and the at least one setting element includes at least two setting elements associated with the respective switches.

17. A method of setting at least one position of an architectural covering according to claim 1, the method comprising the step of setting a first position of the architectural covering in the printed circuit board by inserting an actuating portion of the at least one actuating portion of the tool into the tool receiving section of the control unit so as to act upon the at least one switch.

18. The method of claim 17, in which at least two different positions are set by the same actuating portion of the tool.

19. The method of claim 17, in which at least two different positions are set by two different actuating portions of the tool.

20. The method of claim 17, including the additional step of setting at least one further position of the architectural covering in the printed circuit board by inserting the actuating portion of the at least one actuating portion of the tool into the tool receiving section of the control unit so as to act upon the at least one switch, wherein the orientation of the tool is changed for setting the different positions of the architectural covering.

21. The method of claim 20, in which the tool is reversed about at least one of its axes for setting two different positions of the architectural covering.

22. An architectural covering comprising:

a control unit configured to control a motor to adjust the position of the architectural covering, the control unit comprising:

a housing including a tool receiving section; and a printed circuit board provided with at least two switches for setting at least two positions of the architectural covering; and a tool including a first actuating portion arranged so as to be introduced into the tool receiving section in two different orientations, the first actuating portion including a first actuating surface arranged so as to actuate different arrangements of the at least two switches dependent on the orientation of the tool.

23. The architectural covering of claim 22, wherein the tool further includes a second actuating portion including a second actuating surface arranged so as to actuate a different arrangement of the at least two switches than the first actuating surface.

24. The architectural covering of claim 23, wherein the first actuating portion and the second actuating portion are arranged on opposite ends of the tool.

* * * * *